US011370088B2

(12) United States Patent
Bendorf

(10) Patent No.: US 11,370,088 B2
(45) Date of Patent: Jun. 28, 2022

(54) LOCKING PLIERS RELEASE MECHANISM

(71) Applicant: Snap-on Incorporated, Kenosha, WI (US)

(72) Inventor: Scott A. Bendorf, Kenosha, WI (US)

(73) Assignee: Snap-on Incorporated, Kenosha, WI (US)

( * ) Notice: Subject to any disclaimer, the term of this patent is extended or adjusted under 35 U.S.C. 154(b) by 371 days.

(21) Appl. No.: 16/433,604

(22) Filed: Jun. 6, 2019

(65) Prior Publication Data

US 2020/0384613 A1 Dec. 10, 2020

(51) Int. Cl.
*B25B 7/12* (2006.01)
*B25B 7/02* (2006.01)

(52) U.S. Cl.
CPC ..... *B25B 7/123* (2013.01); *B25B 7/02* (2013.01)

(58) Field of Classification Search
CPC ..... B25B 7/123; B25B 7/02
See application file for complete search history.

(56) References Cited

U.S. PATENT DOCUMENTS 2,489,895 A 11/1949 Kash
2,519,973 A 8/1950 Mead
2,523,385 A 9/1950 Mead
2,705,899 A 4/1955 Berger
3,208,319 A 9/1965 Westby et al.
3,285,107 A 11/1966 Kasper
3,354,759 A 11/1967 Cook
3,545,316 A 12/1970 Patrick
4,989,479 A * 2/1991 Anderson ..... B25B 7/02 81/186
5,056,385 A 10/1991 Petersen
5,385,072 A 1/1995 Neff
5,460,065 A 10/1995 Balmer
5,503,049 A * 4/1996 Chervenak ..... B25B 7/123 81/427.5
6,012,361 A 1/2000 Wooster, Jr. et al.
6,227,080 B1 5/2001 Grayo et al.
6,626,070 B2 9/2003 Peperkorn et al.
(Continued)

FOREIGN PATENT DOCUMENTS

CN 2065117 U 11/1990
CN 2685007 Y 3/2005
(Continued)

OTHER PUBLICATIONS

Taiwan Office Action for Application No. 11020082770 dated Jan. 28, 2021, 5 pages.

(Continued)

*Primary Examiner* — Hadi Shakeri
(74) *Attorney, Agent, or Firm* — Seyfarth Shaw LLP

(57) ABSTRACT

Disclosed is a release mechanism for locking pliers. The mechanism includes a center link and release link that work together to form an over-center lock with a release lever that acts sequentially on the center link and release link. The release lever can first contact the center link at a protrusion, and then contact a release link connected to the center link to release the over-center lock. User experience is therefore improved by a sequential unlocking operation that reduces the amount of leverage required to unlock the pliers.

20 Claims, 3 Drawing Sheets

(56) References Cited

U.S. PATENT DOCUMENTS

| | | | | |
|---|---|---|---|---|
| 7,216,570 | B2 * | 5/2007 | Seber | B25B 7/10 81/368 |
| 7,454,999 | B2 | 11/2008 | Wu | |
| 7,472,632 | B2 | 1/2009 | Engvall et al. | |
| 8,656,813 | B1 | 2/2014 | Aldredge et al. | |
| 8,950,299 | B2 | 2/2015 | Wu | |
| 9,216,494 | B2 | 12/2015 | Lai | |
| 9,844,857 | B2 * | 12/2017 | Skodje | B25B 7/123 |
| 10,112,287 | B2 | 10/2018 | Gallagher | |
| 10,207,393 | B2 * | 2/2019 | Wu | B25B 7/123 |
| 2002/0162427 | A1 | 11/2002 | Miller et al. | |
| 2003/0141425 | A1 | 7/2003 | Gallagher | |
| 2004/0255729 | A1 | 12/2004 | Poole et al. | |
| 2007/0209484 | A1 | 9/2007 | Chervenak et al. | |
| 2015/0000477 | A1 | 1/2015 | Wu | |
| 2015/0283681 | A1 | 10/2015 | Wu | |
| 2017/0120423 | A1 | 5/2017 | Wang | |
| 2020/0094382 | A1 | 3/2020 | Blumenthal et al. | |

FOREIGN PATENT DOCUMENTS

| | | | |
|---|---|---|---|
| CN | 201098850 | Y | 8/2008 |
| CN | 101306519 | A | 11/2008 |
| CN | 104827412 | A | 8/2015 |
| CN | 10397129 | A | 3/2019 |
| CN | 109397126 | A | 3/2019 |
| DE | 202007016295 | | 3/2008 |
| EP | 216717 | | 4/1987 |
| GB | 1125395 | A | 8/1968 |
| TW | M316138 | | 8/2007 |
| TW | M525822 | | 7/2016 |
| WO | 2017165591 | A1 | 9/2017 |

OTHER PUBLICATIONS

Examination Report No. 1 for Application No. 2020201981 dated Mar. 5, 2021, 8 pages.

Combined Search and Examination Report for Application No. GB2004581.1 dated Oct. 8, 2020, 5 pages.

Chinese Office Action for corresponding Application No. 202010502180.9 dated Sep. 3, 2021, 8 pages.

Canadian Office Action for corresponding CA Application No. 3,081,852, dated Jun. 29, 2021, 4 pages.

Chinese Office Action for corresponding Application No. 202010502180.9 dated Mar. 25, 2022, 9 pages.

Examination Report No. 2 for corresponding Application No. 2020201981 dated Feb. 18, 2022, 4 pages.

* cited by examiner

LOCKING PLIERS RELEASE MECHANISM

TECHNICAL FIELD OF THE INVENTION

The present invention generally relates to pliers. More particularly, the present invention relates to a locking pliers mechanism that releases the locking function of the pliers.

BACKGROUND OF THE INVENTION

Locking pliers are an adjustable hand tool used to rotate work pieces or provide a clamping function to grip two materials at the same time. The pliers include jaws that can be adjusted by a screw to increase or decrease the gap between the jaws based on the size of the work piece or material being gripped by the locking pliers. For example, a pair of locking pliers can include a screw on an upper handle of the pliers that, when rotated, pushes on a center link connected to one of the jaws to raise or lower the jaw, relative to the other jaw.

Locking pliers are also able to lock by lifting the lower jaw upward until it is prevented from further moving upward due to, for example, the interaction between a release lever adjacent the lower handle and a center link connecting the upper handle to the lower handle. To release the locking feature, the release lever can then be lifted away from the lower handle to pry the lower handle away from the center link. To lock the pliers again, the user can lift up on the lower handle to push the release lever toward the upper handle and lock in place when the release lever abuts the center link. Yet, some locking pliers require excessive force to lock and unlock the handles.

SUMMARY OF THE INVENTION

The present invention broadly comprises a release mechanism for a pair of locking pliers that allows release of the locking function with reduced effort. The mechanism includes a center link and release link that work together to form an over-center lock with a release lever that acts on both the center link and release link. For example, the release lever can first contact the center link at a protrusion, and then contact a release link connected to the center link to release the over-center lock. This unlocking operation improves user experience by reducing the amount of leverage required to unlock the pliers.

In particular, the present invention broadly comprises a tool including first and second handles respectively including first and second jaws extending from the first and second handles, an elastic member coupling the second jaw to the first handle, and a center link pivotably coupled to the release link and coupled to the first handle. The center link can have a protrusion protruding from the center link toward the second handle and the tool can further include an adjustment screw having a head on a first end and a point on a second end and threads extending at least partially therebetween. The adjustment screw can be threadably inserted into the first handle for adjusting a jaw gap between the first and second jaws. The tool can further include a release lever rotatably coupled to the second handle and having an abutment protruding from the release lever and an extension extending from an end of the release lever, the abutment abutting the protrusion in a closed state and being spaced from the protrusion in an unlocked state. Further included can be a release link coupled to the second handle and dimensioned to receive the extension during a releasing operation in which the release lever is rotated away from the second handle, where the abutment abuts the protrusion prior to the extension abutting the release link during the releasing operation.

The present invention can further broadly comprise a tool including a first handle, a first jaw coupled to the first handle, and a second handle including a second handle contact point. Further included are a second jaw pivotably coupled to the second handle, and a center link pivotably coupled to the release link and coupled to the first handle. The center link can have a first center link contact point and the tool can include a release lever rotatably coupled to the second handle and having a first release lever contact point and a second release lever contact point spaced from the first release lever contact point. The first center link contact point contacts the first release lever contact point in a locked state and the first release lever contact point is spaced from the first center link contact point in an unlocked state. The first center link contact point contacts the first release lever contact point in a first portion of a release operation in which the release lever is moved away from the second handle, and the second release lever contact point contacts the release link contact point during a second portion of the release operation subsequent to the first portion.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION OF THE EMBODIMENTS

Figure 1:
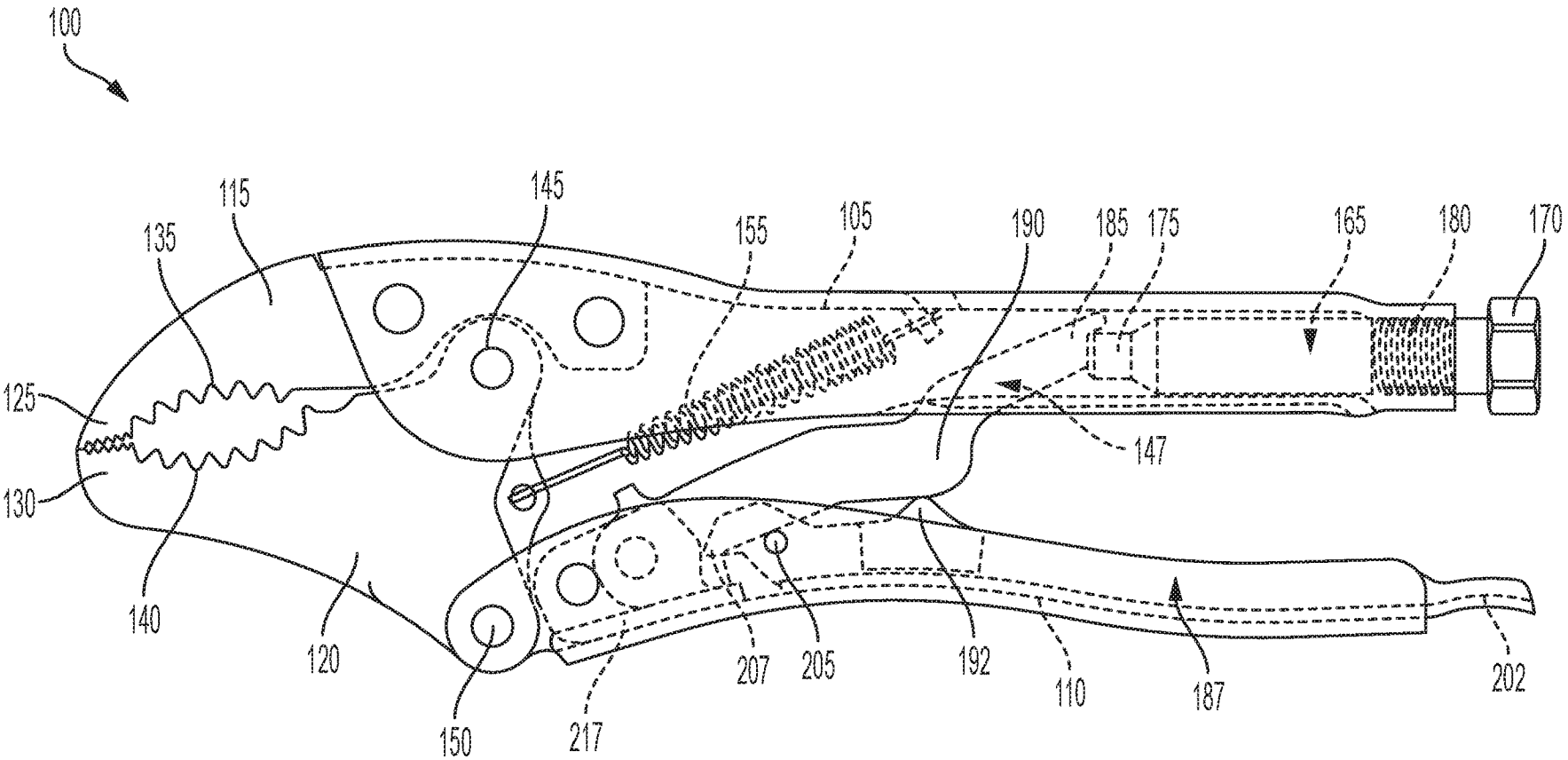
FIG. 1 is a side view of pliers with a release mechanism in the closed state according to at least one of the presently disclosed embodiments.

While this invention is susceptible of embodiments in many different forms, there is shown in the drawings, and will herein be described in detail, a preferred embodiment of the invention with the understanding that the present disclosure is to be considered as an exemplification of the principles of the invention and is not intended to limit the broad aspect of the invention to embodiments illustrated. As used herein, the term "present invention" is not intended to limit the scope of the claimed invention and is instead a term used to discuss exemplary embodiments of the invention for explanatory purposes only.

The present invention broadly comprises a release mechanism for locking pliers. The mechanism is comprised of a center link and release link that work together to form an over-center lock with a release lever that acts sequentially on the center link and release link. The release lever can first contact the center link at a protrusion, and then contact a release link connected to the center link to release the over-center lock. User experience is therefore improved by a sequential unlocking operation that reduces the amount of leverage required to unlock the pliers.

Figure 2:
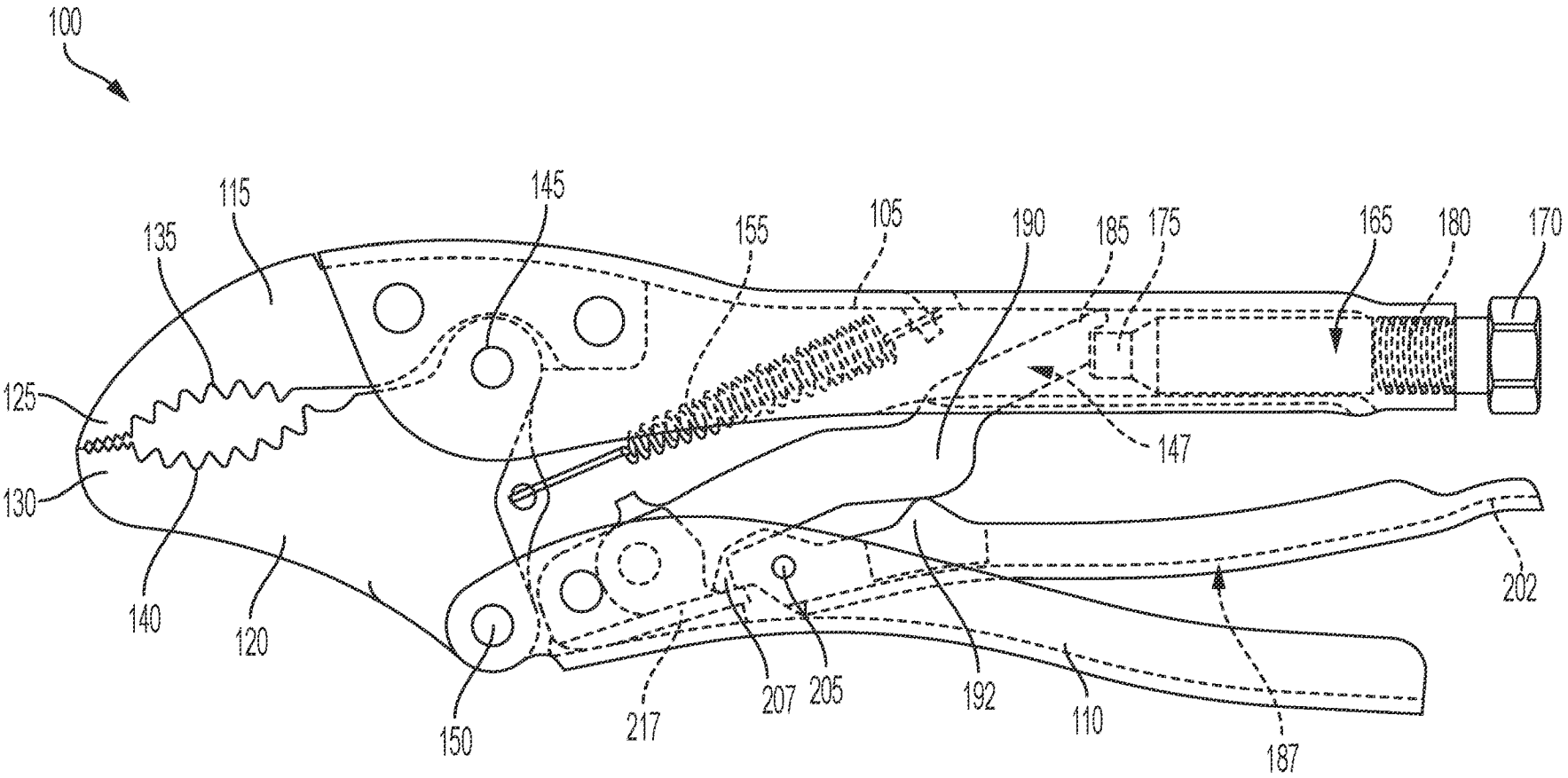
FIG. 2 is a side view of pliers with a release mechanism in the partially-actuated state according to at least one of the presently disclosed embodiments.
Figure 3:
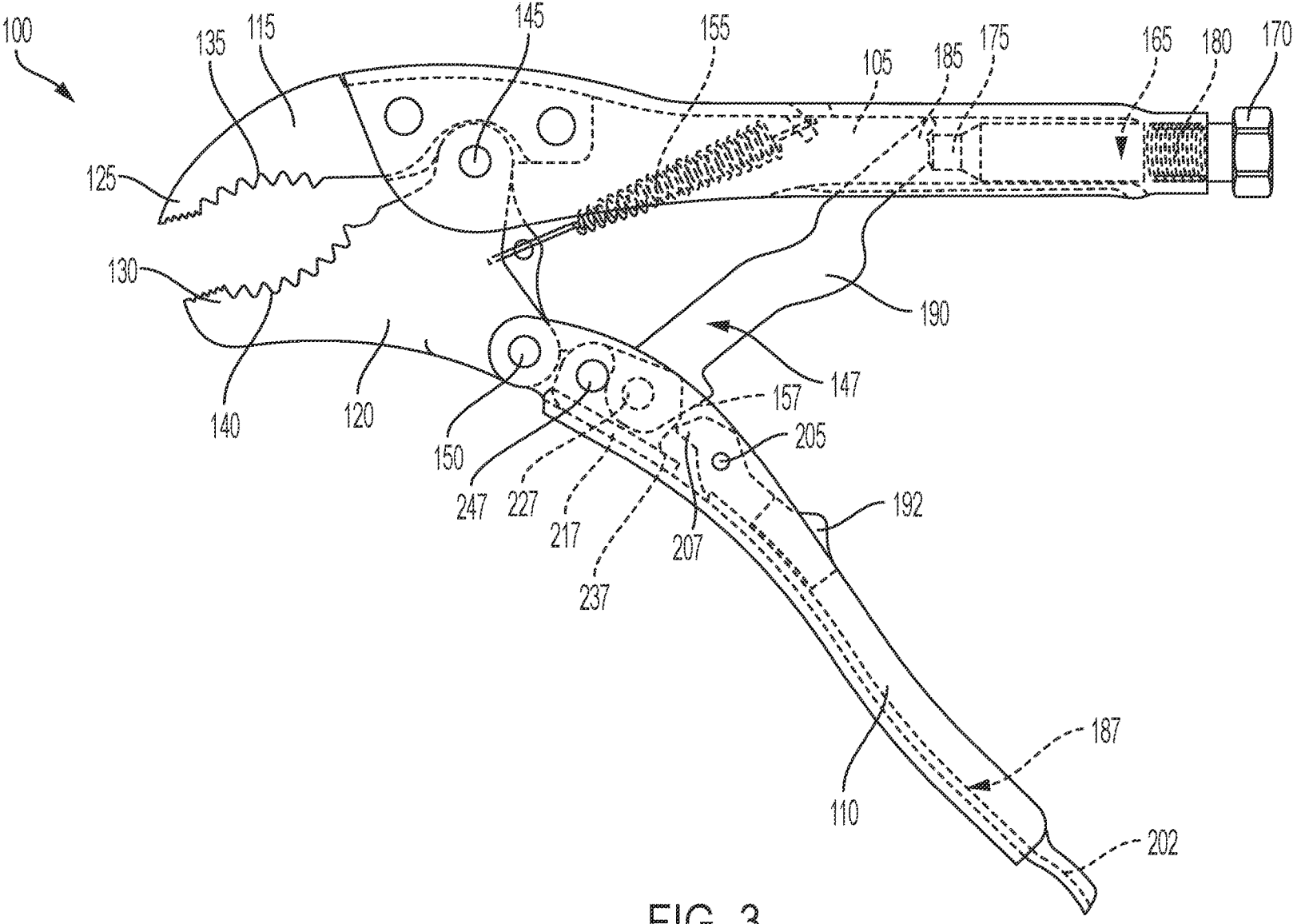
FIG. 3 is a side view of pliers with a release mechanism in the released state according to at least one of the presently disclosed embodiments.

As shown in FIGS. 1-3, a tool 100 such as a pair of locking pliers, includes a first handle 105 and a second handle 110 pivotally coupled to one another. First 115 and second 120 jaws can respectively extend from the first 105 and second 110 handles. Similarly, first 125 and second 130 noses can respectively extend from the first 115 and second 120 jaws. The first 125 and second 130 noses can grip smaller work pieces with greater precision as compared to the first 115 and second 120 jaws. As shown, the teeth of the first 125 and second 130 noses are smaller and the gap between them is also smaller as compared to first 135 and second 140 teeth of the first 115 and second 120 jaws. The first 125 and second 130 noses can also be used in a clamping operation to clamp working materials together, or to clamp on a single working material, due to the parallel nature of the teeth of the noses 125, 130.

The handles 105, 110 and the jaws 115, 120 couple together at various pivot points to facilitate the operation of the tool 100. For example, the second jaw 120 can couple to the first handle 105 at a first jaw pivot 145 and can couple to the second handle 110 at a second jaw pivot 150. The second jaw 120 can also couple to the first handle 105 with an elastic member 155 that pulls the handles 105, 110 open or closed depending on the position of the handles 105, 110. In an embodiment, the first handle 105 is fixedly coupled to the first jaw 115 and the second handle 110 is rotatably coupled to the second jaw 120.

As discussed above, the tool 100 can also include a center link 147 coupled to the release link at the release link pivot 227. The center link 147 interacts with an adjusting screw 165 to adjust the jaw gap between the first 115 and second 120 jaws. As shown, the adjusting screw 165 can include a head 170 on a first end and a point 175 on a second end opposite the first end, with threads 180 extending at least partially therebetween. To adjust the jaw gap between the jaws 115, 120, the user can rotate the head 170 of the adjusting screw 165 in a desired rotational direction and move the adjusting screw 165 axially inward or outward based on the functionality of the threads 180. For example, for right handed threads 180, the user can rotate the head 170 of the adjusting screw 165 clockwise to thereby push the point 175 of the adjusting screw 165 against a face 185 of the center link 147. In so doing, the center link 147 will push the second jaw 120 towards the noses 125, 130 at the second jaw pivot 150 (i.e., will push the second jaw pivot 150 left, if viewing from the angle shown in FIGS. 1-3), and thereby decrease the jaw gap between the jaws 115, 120. Alternatively, the user can rotate the head 170 of the adjusting screw 165 counterclockwise to increase the jaw gap by pulling at the second jaw pivot 150 in a manner opposite that described above.

As discussed above, in some embodiments the tool 100 can lock in manner that fixes the jaw gap between the first 115 and second 120 jaws. To lock the tool 100, the second handle 110 is pulled toward the first handle 105. The clamping force on the second jaw 120 is transmitted about pivot 145 and can be modeled as an imaginary line (referred to as the "power line" in prior art) from pivot 150 to point 175 on adjustment screw 165. The tool 100 is locked when center link 147 and release link 217 are moved upward past this imaginary line but are prevented from moving further toward first handle 105 by the interaction of protrusion 157 and abutment 237 and protrusion 190 and abutment 192. To release the locking function, the tool 100 includes a reverse lever 187 that can be lifted upward and thereby push against the center link 147 connecting the first handle 105 and the release link 217. As shown, the center link 147 can include a protrusion 190 and the release lever 187 can include an abutment 192 that contact one another to prevent further closing of the first 105 and second 110 handles with respect to one another. The abutment 192 can further act as a first contact point during the releasing operation, when the user lifts upward on the release lever 187 at a tab 202 located on the end of the release lever 187. Here, the abutment 192 can contact the protrusion 190 and pry the second handle 110 away from the center link 147 in a first portion of the releasing operation. The center link 147 can also include a protrusion 157 and the release link 217 can include a matching abutment 237 such that in the closed position, protrusion 157 and abutment 237 prevent center link 147 and release link 217 from moving relative to one another. In a second portion of the releasing operation, the release lever 187 can rotate about a release pivot 205 and cause an extension 207 to contact a release link 217 to rotate release link 217 about pivot 247 and release the over-center lock of the compound linkage formed by center link 147 and release link 217, subsequent the first portion of the releasing operation.

The release link 217 can be a separate element from the lower handle 110. In an embodiment, the release link 217 extends in a plane above the second handle 110 (i.e., in a plane closer to the elastic member 155) as shown in, for example, FIG. 2, the release link 217 can be rotatably coupled to the center link 147 and extend at an angle to the lower handle 110 when the release lever 187 is lifted upward during the releasing operation.

The releasing operation of the presently disclosed embodiments is advantageous over prior art releasing operations by including a compound linkage formed by center link 147 and release link 217 and a release lever 187 that acts on both elements of the compound linkage to release the over-center lock. For example, as shown in FIG. 1, the abutment 192 of the release lever 187 can first contact the protrusion 190 of the center link 147 to initiate a first prying motion. Thereafter, the extension 207 of the release lever 187 can contact release link 217 to rotate release link 217 about pivot 247 to break the over-center lock of the compound center linkage formed by center link 147 and release link 217, as shown in FIG. 2, leading to a fully released tool 100, as shown in FIG. 3. In this manner, the user can more easily unlock the tool 100 and open the jaws 115, 120 away from each other to quickly release the grip of the tool 100 on the work piece or the working materials.

As used herein, the term "coupled" and its functional equivalents are not intended to necessarily be limited to direct, mechanical coupling of two or more components. Instead, the term "coupled" and its functional equivalents are intended to mean any direct or indirect mechanical, electrical, or chemical connection between two or more objects, features, work pieces, and/or environmental matter. "Coupled" is also intended to mean, in some examples, one object being integral with another object.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of the inventors' contribution. The actual scope of the protection sought is intended to be defined in the following claims when viewed in their proper perspective based on the prior art.

What is claimed is:

1. A tool comprising:

a first handle;

a first jaw coupled to the first handle;

a second handle;

a second jaw pivotably coupled to the second handle;

an elastic member coupling the second jaw to the first handle;

a center link coupled to the first handle, the center link having a protrusion protruding from the center link toward the second handle;

an adjustment screw threadably engaged with the first handle for adjusting a jaw gap between the first and second jaws;

a release lever rotatably coupled to the second handle and having an abutment protruding from the release lever and first and second opposing ends, wherein an extension extends from the second end, and the abutment abuts the protrusion in a closed state and is spaced from the protrusion in an unlocked state; and a release link coupled to the second handle and the center link, wherein the release link is adapted to receive the extension during a releasing operation in which the release lever is rotated such that the first end moves away from the second handle and the extension moves towards the release link, and wherein the abutment abuts the protrusion prior to the extension being received by the release link during the releasing operation.

2. The tool of claim 1, wherein the release link is a separate component from the second handle.

3. The tool of claim 2, wherein the release link extends in a plane closer to the elastic member as compared to the second handle.

4. The tool of claim 2, wherein the release link is rotatably coupled to the center link.

5. The tool of claim 1, wherein the adjustment screw is adapted to be rotated clockwise to reduce the jaw gap, and is adapted to be rotated counterclockwise to increase the jaw gap.

6. The tool of claim 1, wherein the center link includes a face and wherein the adjustment screw abuts the face during an adjustment operation in which the jaw gap is adjusted.

7. The tool of claim 1, wherein the release lever has a tab on the first end.

8. The tool of claim 1, further comprising first and second noses respectively extending from the first and second jaws.

9. The tool of claim 8, wherein the first nose has first nose teeth and the second nose has second nose teeth, and wherein the first nose teeth and the second nose teeth are parallel to one another.

10. A tool comprising:

a first handle;

a first jaw coupled to the first handle;

a second handle;

a release link coupled to the second handle;

a second jaw pivotably coupled to the second handle;

a center link pivotably coupled to the release link and coupled to the first handle, the center link having a first center link contact point; and a release lever rotatably coupled to the second handle, and having first and second opposing ends, a first release lever contact point, and a second release lever contact point spaced from the first release lever contact point and disposed on the second end, the first center link contact point contacting the first release lever contact point in a locked state and the first release lever contact point being spaced from the first center link contact point in an unlocked state, wherein the first center link contact point contacts the first release lever contact point in a first portion of a release operation in which the release lever is rotated such that the first end is moved away from the second handle and the second end is moved towards the release link, and wherein the second release lever contact point contacts the release link during a second portion of the release operation subsequent to the first portion.

11. The tool of claim 10, further comprising an elastic member coupling the second jaw to the first handle.

12. The tool of claim 10, further comprising an adjustment screw threadably engaged with the first handle for adjusting a jaw gap between the first and second jaws.

13. The tool of claim 12, wherein the adjustment screw is adapted to be rotated clockwise to reduce the jaw gap, and is adapted to be rotated counterclockwise to increase the jaw gap.

14. The tool of claim 12, wherein the center link includes a face and wherein the adjustment screw abuts the face during an adjustment operation in which the jaw gap is adjusted.

15. The tool of claim 10, wherein the release link is a separate component from the second handle.

16. The tool of claim 15, wherein the release link is rotatably coupled to the center link.

17. The tool of claim 15, further comprising an elastic member coupling the second jaw to the first handle and wherein the release link extends in a plane closer to the elastic member as compared to the second handle.

18. The tool of claim 10, wherein the release lever has a tab on the first end.

19. The tool of claim 10, further comprising first and second noses respectively extending from the first and second jaws.

20. The tool of claim 19, wherein the first nose has first nose teeth and the second nose has second nose teeth, and wherein the first nose teeth and the second nose teeth are parallel to one another.

* * * * *